US005529035A

United States Patent [19]

Hunt et al.

[11] Patent Number: 5,529,035

[45] Date of Patent: Jun. 25, 1996

[54] COLD START FUEL INJECTOR WITH HEATER

[75] Inventors: Frank W. Hunt, White Lake; Toshiharu Nogi, Novi, both of Mich.

[73] Assignee: Hitachi America, Ltd., Tarrytown, N.Y.

[21] Appl. No.: 335,993

[22] Filed: Nov. 8, 1994

[51] Int. Cl.[6] ..... F02M 53/06; F02N 17/04

[52] U.S. Cl. ..... 123/179.15; 123/179.21; 123/524

[58] Field of Search ..... 123/179.15, 179.13, 123/179.21, 549, 548, 524, 179.12, 179.14

[56] References Cited

U.S. PATENT DOCUMENTS

| | | | |
|---|---|---|---|
| 909,897 | 1/1909 | Hertzberg | 123/549 |
| 3,812,830 | 5/1974 | Traisnel | 123/491 |
| 4,187,821 | 2/1980 | Zebli | 123/179.18 |
| 4,216,757 | 8/1980 | Romann | 123/179.15 |
| 4,286,553 | 9/1981 | Baltz et al. | 123/179.11 |
| 4,318,374 | 3/1982 | Yasuhara | 123/179.21 |
| 4,325,341 | 4/1982 | Yamauchi et al. | 123/549 |
| 4,372,261 | 2/1983 | Sarto | 123/179.3 |
| 4,390,000 | 6/1983 | Igashira et al. | 123/549 |
| 4,705,004 | 11/1987 | Takahashi et al. | 123/491 |
| 4,825,834 | 5/1989 | Toshimitsu et al. | 123/463 |
| 5,007,390 | 4/1991 | Tanaka et al. | 123/179.15 |
| 5,148,788 | 9/1992 | Saikalis | 123/339.27 |
| 5,150,673 | 9/1992 | Hoshiba et al. | 123/179.15 |
| 5,156,133 | 10/1992 | Sugimoto et al. | 123/533 |
| 5,218,943 | 6/1993 | Takeda et al. | 123/531 |
| 5,284,117 | 2/1994 | Akase | 123/445 |
| 5,331,937 | 7/1994 | Clarke | 123/491 |

FOREIGN PATENT DOCUMENTS

| | | | |
|---|---|---|---|
| 56-6056 | 1/1981 | Japan | 123/549 |

OTHER PUBLICATIONS

Nogi, et al., "Mixture Formation of Fuel Injection Systems in Gasoline Engines" SAE 880558, 1988, pp. 97–104.

Cold Start Performance of an Automotive Engine Using Prevaporized Gasoline, R. J. Boyle et al, The Engineering Society for Advancing Mobility Land Sea Air and Space, Mar. 1, 1993.

"Investigation of High Response Fuel Injection Systems", T. Yamauchi, T. Sasayama, ISATA 90613, Dec. 1990, pp. 48–54.

"Development of Air–Assisted Injector System", K. Harada et al. SAE 920294, Feb. 1992, pp. 55–62.

*Primary Examiner*—Andrew M. Dolinar

*Attorney, Agent, or Firm*—Gifford, Krass, Groh, Sprinkle, Patmore, Anderson & Citkowski

[57] ABSTRACT

A cold start fuel injector is disclosed for use with an internal combustion engine of the type having an intake manifold and a fuel injection system. The cold start fuel injector includes a housing having a fuel inlet and a fuel outlet. An outlet contained within the housing is fluidly connected to the fuel inlet and, when provided pressurized fuel at its inlet, generates a fuel spray into the intake manifold. A tubular and cylindrical heater is provided around the outlet from the nozzle so that the fuel spray from the nozzle passes through the heater and, in doing so, is vaporized for better fuel combustion and, thus, reduced emissions. Additionally, a mesh is preferably provided within the interior of the heater. This mesh which is optionally heated prevents large droplets of fuel from contacting and unduly cooling the heater. Similarly, fuel at a reduced pressure is provided to the nozzle of the cold start fuel injector. This relatively low fuel pressure also minimizes cooling of the heater during operation of the cold start fuel injector.

18 Claims, 3 Drawing Sheets

COLD START FUEL INJECTOR WITH HEATER

BACKGROUND OF THE INVENTION

I. Field of the Invention

The present invention relates to fuel injection systems for internal combustion engines and, more particularly, to a cold start fuel injector for such a fuel system.

II. Description of the Prior Art

In internal combustion engines which utilize fuel injection systems, it is conventional to utilize a cold start fuel injector to provide fuel to the engine while the engine is cold. Typically, a single cold start fuel injector supplies fuel to the intake manifold for the engine and thus for all of the engine cylinders.

In order to supply fuel to the cold start injector, the cold start injector has a fuel inlet which is fluidly connected to the fuel rail for the engine. The fuel rail for the engine, in turn, is pressurized by the fuel pump to relatively high pressure, typically 40 psi. This pressurized fuel is supplied via a pulsed valve to the cold start fuel injector nozzle which generates a fuel spray each time the valve is opened. Additionally, secondary air may be provided to the fuel injector nozzle in order to further enhance the atomization of the fuel.

Even the use of secondary air flow through the cold start fuel injector is not sufficient to vaporize the fuel to a level necessary to meet the projected emission regulations for automotive vehicles. Consequently, in order to further enhance vaporization of the fuel, there have been previously known systems which utilize a heater at the outlet from the cold start fuel injector which further enhances fuel vaporization. Such heaters, however, have not proven wholly satisfactory in use.

One disadvantage of these previously known heaters is that the fuel spray from the cold start fuel injector, and particularly, the larger droplets of fuel spray, tend to rapidly cool the heater. This cooling of the heater results in larger fuel droplet size.

Similarly, these previously known cold start fuel injectors utilize relatively short bursts of high pressure fuel to supply fuel to the engine. These high pressure short bursts of fuel also result in larger fuel droplet size and, thus, less efficient fuel combustion.

SUMMARY OF THE PRESENT INVENTION

The present invention provides a cold start fuel injector which overcomes the above mentioned disadvantages of the previously known devices.

Like the previously known cold start fuel injectors, the cold start fuel injector of the present invention includes a housing having a fuel inlet and a fuel spray outlet open to the intake manifold of the engine. A valve is contained within the housing which selectively connects the fuel inlet to a nozzle in order to produce the fuel spray in pulses synchronized with the engine rotation. Secondary air can also be provided through the cold start fuel injector in order to further enhance the fuel atomization.

A tubular and cylindrical heater, preferably a ceramic heater, is provided around the fuel outlet from the nozzle so that the fuel spray from the nozzle passes through the ceramic heater. The ceramic heater is connected to a source of electricity, typically the battery for an automotive vehicle, which heats the heater to a temperature of about 150° C., i.e. the optimum temperature for atomization of the fuel.

In order to minimize cooling of the heater by the fuel spray, a screen is provided around the interior of the heater so that the fuel spray passes through the interior of the screen and into the intake manifold. The screen or mesh includes a plurality of openings which are dimensioned to preclude large droplets of fuel passing through the screen and onto the heater. Such large droplets not only unduly cool the heater but are not fully atomized by the heater. The screen is also optionally heated for better fuel vaporization.

Conversely, relatively small droplets of fuel pass through the mesh openings and on to the heater which vaporizes these small droplets of fuel in the desired fashion. Furthermore, such small droplets of fuel do not unduly cool the heater so that the heater remains at its optimum temperature to atomize the fuel.

Secondly, in order to further enhance atomization of the fuel, the fuel is supplied to the cold start fuel injector at a reduced pressure from the fuel pressure present at the fuel rail. For example, the pressure at the fuel rail typically is in the range of 40 psi. In the present invention, the fuel pressure to the cold start fuel injector is reduced to a much lower pressure, e.g. 15–25 psi, which further reduces unwanted cooling of the heater.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
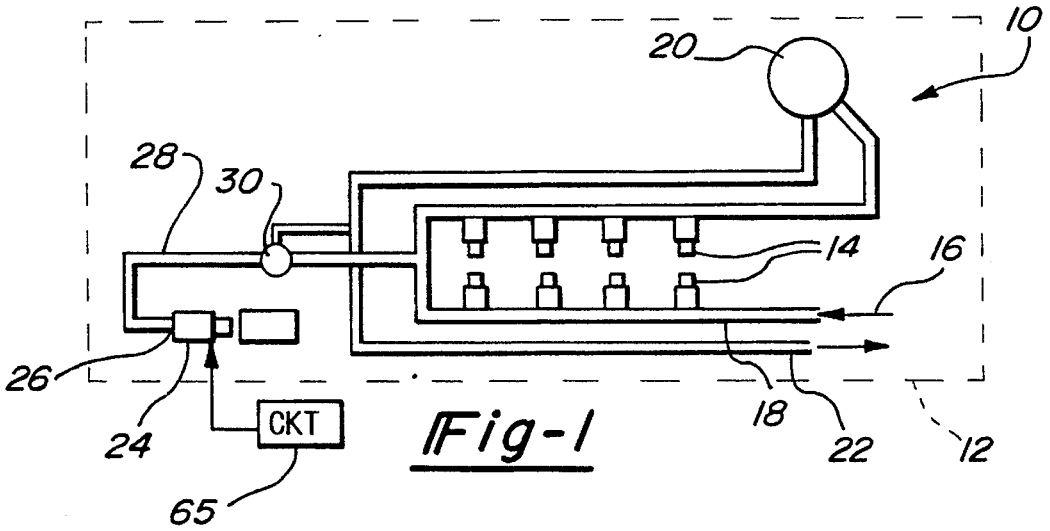
FIG. 1 is a diagrammatic view illustrating a fuel injection system for an internal combustion engine utilizing the cold start fuel injector of the present invention.

With reference first to FIG. 1, a schematic view of a fuel injection system 10 for an internal combustion engine 12 (illustrated only diagrammatically) is thereshown. The fuel injection system 10 includes a plurality of multi-point fuel injectors 14 with one fuel injector 14 associated with each engine cylinder. A fuel pump 16 provides pressurized fuel to a fuel rail 18 which is fluidly connected to each fuel injector 14.

The fuel rail 18 is also fluidly connected via a pressure regulator 20 to a return fuel line 22. Consequently, the fluid pressure within the fuel rail 18 is maintained at a high pressure, typically 40 psi.

The fuel system 10 further includes a cold start fuel injector 24 which supplies fuel to the engine 12 while the engine is cold. The cold start fuel injector 24 has an inlet 26 which is fluidly connected by a fluid line 28 to the fuel rail 18 via a pressure reducer 30. Consequently, the fuel pressure to the cold start fuel injector 24 is at a lower pressure, preferably 15 psi –25 psi, than the pressure of the fuel in the fuel rail 18 for a reason to be subsequently described.

Figure 2:
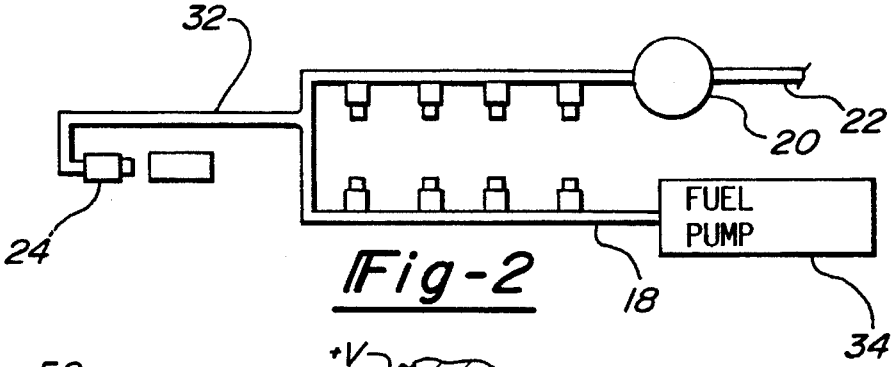
FIG. 2 is a figure similar to FIG. 1 but illustrating a modification thereof.

With reference now to FIG. 2, a modification of the fuel system 10 for the internal combustion engine 12 is thereshown. The embodiment of FIG. 2, like the previously described embodiment, includes a fuel rail 18 which supplies pressurized fuel to the multi-point fuel injectors 14. A cold start fuel injector 24 is also provided for supplying fuel to the engine 12 while the engine is cold. A fluid conduit 32 fluidly connects the fuel rail 18 to the inlet 26 of the cold start fuel injector 24.

Unlike the embodiment of FIG. 1, however, the embodiment of FIG. 2 utilizes a variable pressure fuel pump 34 which pressurizes the fuel rail 18 at a variable pressure as controlled by the fuel management system. Thus, during a cold start engine condition, the fuel pump 34 pressurizes the fuel rail 18 at a relatively low pressure, preferably 15–25 psi, so that this relatively low pressure is provided to the cold start fuel injector 24. Following the cold start engine operation condition, the fuel pump 34 pressurizes the fuel rail 18 at a higher pressure, typically about 40 psi.

For a reason to be subsequently described, in both the FIG. 1 and FIG. 2 embodiments, relatively low pressure fuel, i.e. 15–25 psi, is provided to the inlet 26 of the cold start fuel injector 24.

Figure 3:
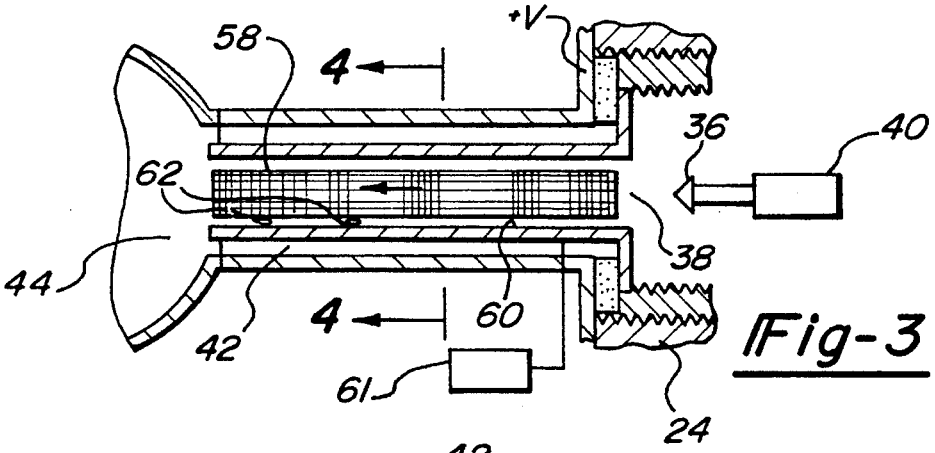
FIG. 3 is a longitudinal sectional view illustrating a preferred embodiment of the cold start injector of the present invention.
Figure 4:
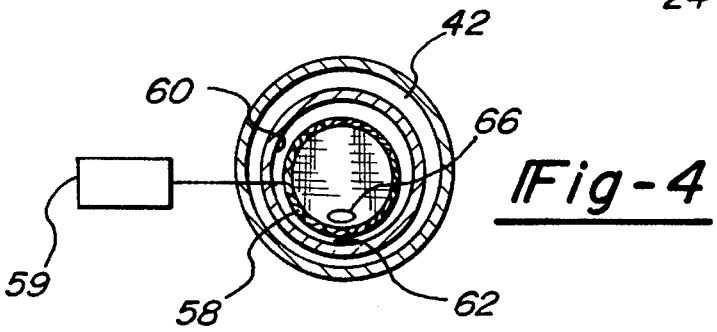
FIG. 4 is a cross sectional view taken substantially along line 4—4 in FIG. 3.

With reference now particularly to FIGS. 3 and 4, the cold start fuel injector 24 includes a nozzle 36 (illustrated only diagrammatically) which directs a fuel spray to an outlet 38 from the cold start fuel injector 24. Additionally, a control valve 40 operated by the fuel management system selectively fluidly connects the fuel inlet 26 (FIG. 1) to the nozzle 36 so that a pulsed fuel spray is provided by the cold start fuel injector 24 to its outlet 38.

Still referring to FIGS. 3 and 4, a tubular and cylindrical heater 42 open at each end extends between the outlet 38 from the cold start injector 24 to an intake manifold 44 for the internal combustion engine 12. The heater 42 is preferably a ceramic heater. Consequently, the fuel spray from the nozzle 36 passes through the heater 42 prior to entering the intake manifold 44 and, in doing so, becomes heated by the heater 42. Such heating of the fuel aids in the vaporization of the fuel and thus provides more efficient engine combustion.

Figure 7:
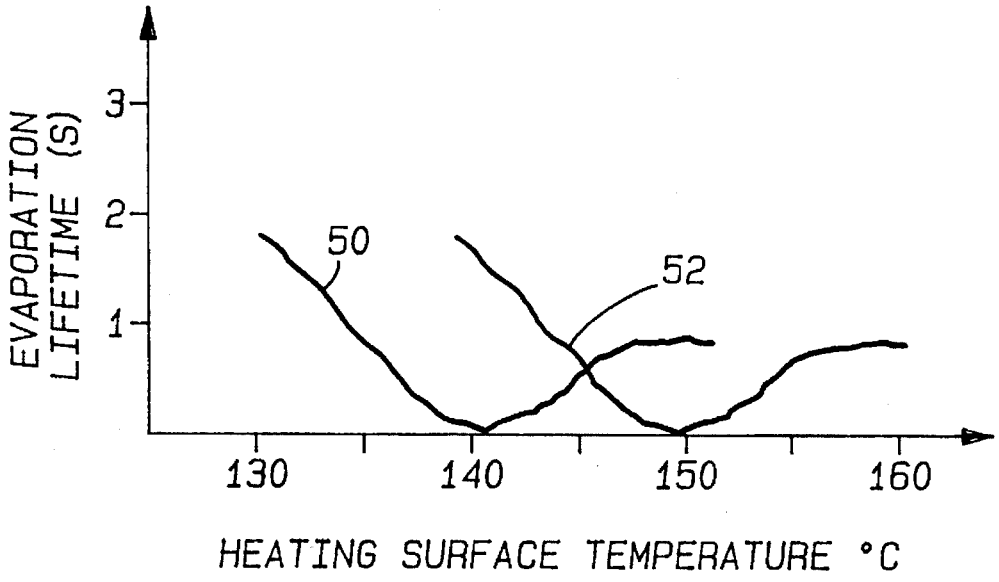
FIG. 7 is a chart illustrating the relationship between fuel evaporation lifetime and temperature of the heater.

With reference now to FIG. 7, FIG. 7 depicts the relationship between the temperature of the heater 42 and the evaporation lifetime of droplets of fuel at vacuum, i.e. closed throttle at graph 50 and droplets of fuel at ambient pressure at graph 52. The evaporation lifetime is minimized for droplets at a temperature of about 150° C. at ambient pressure and about a temperature of 140° C. at vacuum, i.e. closed throttle conditions. Consequently, control of the heater temperature as a function of manifold pressure results in minimization of the evaporation lifetime and maximum efficiency of fuel combustion.

Figure 8:
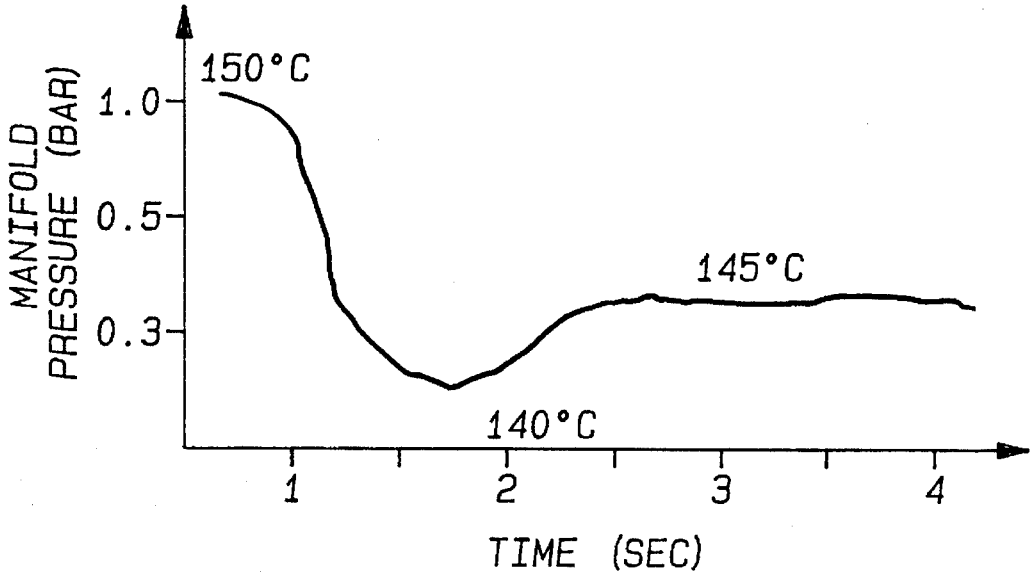
FIG. 8 is a graph illustrating a preferred heater control program.

With reference now to FIG. 8, an exemplary graph of the heater temperature versus time is thereshown for optimum fuel vaporization. At initial engine start up, and assuming an open throttle, the heater temperature is increased by heater control means 61 (FIG. 3) to about 150° C. by increasing the heater voltage. Approximately one-two seconds after engine start up and assuming a closed throttle, the heater voltage is reduced thus lowering the heater temperature to about 140° C. for minimization of the evaporation lifetime. Thereafter, the heater voltage is increased to raise the heater temperature to about 145° C., i.e. between the vacuum and ambient pressure manifold conditions, to minimize evaporation lifetime for changing engine conditions.

Figure 5:
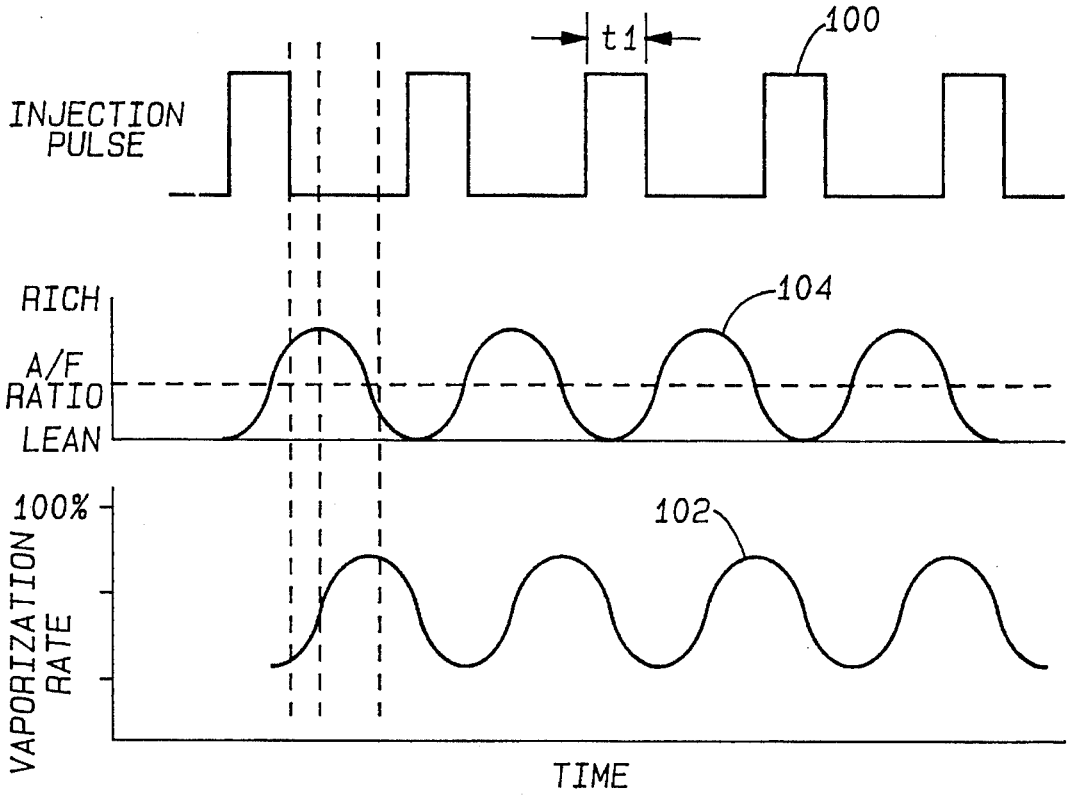
Fig-5 PRIOR ART
FIG. 5 is a graphical view of the prior art illustrating the effect on the air/fuel ratio and vaporization rate of high pressure fuel injection pulses.

With reference now to FIG. 5, the effect on the air/fuel ratio and vaporization rate using high pressure, e.g. 40 psi, is thereshown. Graph 100 depicts the high pressure fuel injection pulses into the cold start injector. Such high pressure fuel injection pulses have the effect of cooling the heater 42 which results in a widely varying vaporization rate as shown at graph 102. This varying vaporization rate, in turn, varies the air/fuel ratio as shown at graph 104 and results in less than optimum fuel combustion.

Figure 6:
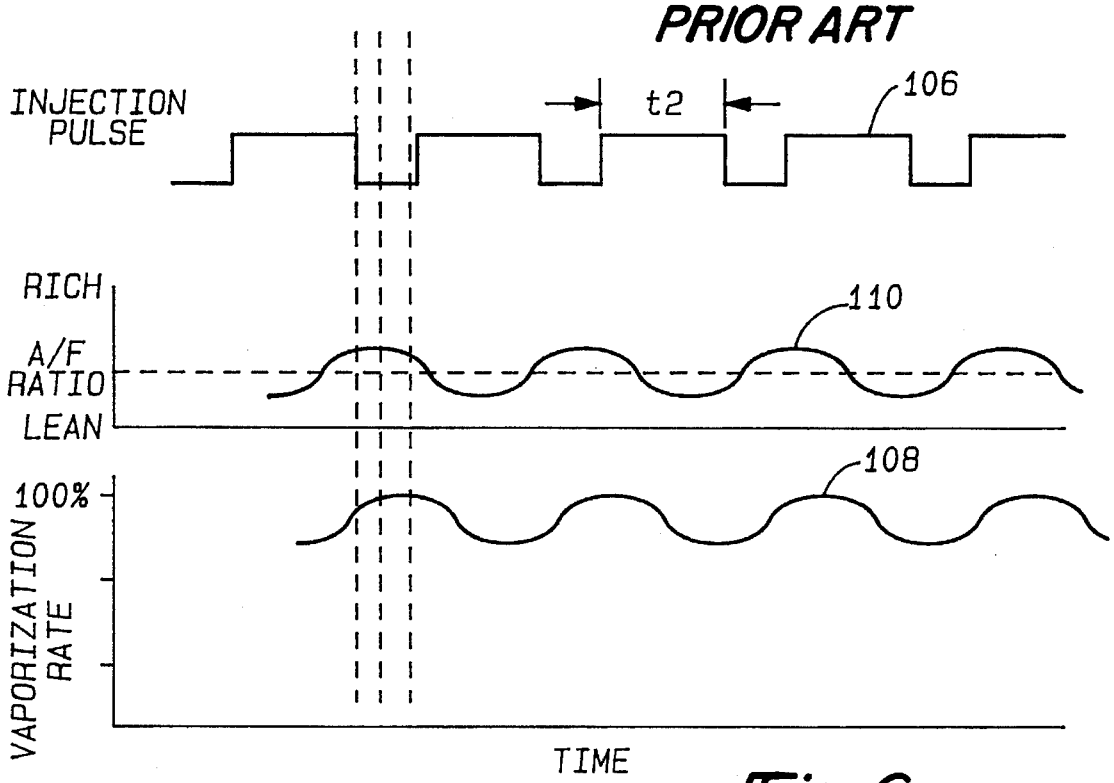
FIG. 6 is a graphical view similar to FIG. 5 but illustrating one embodiment of the present invention.

Referring now to FIG. 6, FIG. 6 illustrates the effect of injecting fuel at a lower pressure, i.e. 15–25 psi, into the cold start injector. Graph 106 illustrates the lower pressure, and thus longer duration, of fuel injection pulses while graphs 108 and 110 illustrate the resulting variation in vaporization rate and air/fuel ratio, respectively. As compared to FIG. 5, the use of lower pressure fuel injection pulses results in higher vaporization rates and smaller air/fuel ratio variation which improves fuel combustion efficiency.

Referring now to FIGS. 3 and 4, in order to further and/or alternatively minimize the temperature variation of the heater 42, a tubular and cylindrical screen or mesh 58 is provided in the interior of the heater 42 so that the mesh 58 is spaced radially inwardly from an interior wall 60 of the heater 42. The nozzle 36, furthermore, is positioned to direct its fuel spray through the interior of the mesh 58.

As best shown in FIG. 3, the size of the holes in the mesh 58 are dimensioned such that only relatively small droplets 62 are able to pass through the mesh 58 and contact the inner surface 60 of the heater 42. These relatively small droplets 62 are completely vaporized by the heater 42 and without unduly cooling the heater 42.

Conversely, the larger droplets 66 (FIG. 4) are unable to pass through the openings in the mesh 58 but, instead, are constrained within the interior of the mesh 58. Since these larger droplets are constrained within the interior of the mesh 58, they do not contact and, therefore, do not cool the heater 42.

The mesh 58 can also be heated by means 59 for improved fuel vaporization.

Although not illustrated in the drawings, the cold start fuel injector 24 may also include air flow through the injector 24 and through the heater 42 in order to further aid in atomization of the fuel.

From the foregoing, it can be seen that the use of a relatively low fuel pressure to the cold start fuel injector either alone or when combined with the provision of the mesh 58 inside the heater 42 effectively minimizes the temperature variation of the heater 42 during a cold start engine operating condition. By such minimization of the temperature variation of the heater 42, it is possible to maintain the temperature of the heater 42 very close to the optimum temperature of about 150° C. for maximum fuel vaporization and thus maximum combustion efficiency.

With reference again to FIG. 1, the heater 24 requires a certain time period, e.g. 1–3 seconds, to reach its optimum operating temperature. In order to activate the heater 24 prior to engine ignition in order to allow heater warm up, the fuel management system may include a circuit 65 to activate the heater 24 prior to engine ignition. The circuit 65 itself is responsive to a door opening of the vehicle, insertion of an ignition key or the like.

Having described my invention, however, many modifications thereto will become apparent to those skilled in the art to which it pertains without deviation from the spirit of the invention as defined by the scope of the appended claims.

I claim:

1. A cold start fuel injector for use with an internal combustion engine having an intake manifold comprising:

a housing having a fuel inlet and a fuel outlet, nozzle means contained in said housing and fluidly connected to said fuel inlet for generating a fuel spray into the intake manifold, means for heating the fuel spray from said nozzle means to thereby vaporize the fuel spray, and means for minimizing temperature variation of said heating means wherein the internal combustion engine comprises a fuel injection internal combustion engine having a fuel rail and means for pressurizing said fuel rail to a first present pressure and comprising means for fluidly connecting the fuel rail to said housing inlet, said temperature minimizing means comprising means for regulating fuel pressure at said fuel outlet to a second preset pressure, said second preset pressure being less than said first preset pressure.

2. The invention as defined in claim 1 wherein said fuel pressure regulating means comprises a pressure regulator fluidly connected between the fuel rail and the fuel inlet.

3. The invention as defined in claim 1 wherein said fuel pressure regulating means comprises a variable pressure fuel pump which provides pressurized fuel to the fuel rail.

4. The invention as defined in claim 1 wherein said second preset pressure is in the range of 15–25 psi.

5. The invention as defined in claim 1 wherein said engine is used with a vehicle having an entry door, and means responsive to opening of said entry door for activating said heating means.

6. The invention as defined in claim 5 and comprising means for sensing the temperature of the engine and for deactivating said heating means when the engine temperature exceeds a predetermined threshold.

7. The invention as defined in claim 1 wherein said engine is used with a vehicle having a key ignition, and means responsive to insertion of a key into the key ignition for activating said heating means.

8. The invention as defined in claim 1 and comprising means for introducing an air flow into said fuel spray.

9. A cold start fuel injector for use with an internal combustion engine having an intake manifold comprising:

a housing having a fuel inlet and a fuel outlet, nozzle means contained in said housing and fluidly connected to said fuel inlet for generating a fuel spray into the intake manifold, means for heating the fuel spray from said nozzle means to thereby vaporize the fuel spray, and means for minimizing temperature variation of said heating means wherein said heating means comprises a tubular heater having an inner surface which defines a passageway through which the fuel spray from said nozzle means flows wherein said temperature minimizing means comprises a mesh secured to and spaced inwardly from the inner surface of said heater.

10. The invention as defined in claim 9 wherein said heater is cylindrical in shape.

11. The invention as defined in claim 9 wherein said heater is a ceramic heater.

12. The invention as defined in claim 9 wherein said mesh overlies substantially the entire inner surface of said heater.

13. The invention as defined in claim 12 wherein said mesh has a hole size dimensioned to prevent fuel droplets larger than a preset size from passing through said mesh.

14. The invention as defined in claim 9 wherein said engine is used with a vehicle having an entry door, and means responsive to opening of said entry door for activating said heating means.

15. The invention as defined in claim 14 and comprising means for sensing the temperature of the engine and for deactivating said heating means when the engine temperature exceeds a predetermined threshold.

16. The invention as defined in claim 9 wherein said engine is used with a vehicle having a key ignition, and means responsive to insertion of a key into the key ignition for activating said heating means.

17. The invention as defined in claim 9 and comprising means for introducing an air flow into said fuel spray.

18. The invention as defined in claim 9 and comprising means for heating said mesh.

* * * * *